US005379993A

United States Patent [19]

Takemura et al.

[11] Patent Number: 5,379,993

[45] Date of Patent: Jan. 10, 1995

[54] AUTOMATIC DOCUMENT FEEDER

[75] Inventors: Kazutaka Takemura, Osaka; Akiyoshi Johdai, Toyokawa; Hirokazu Matsuo, Toyohashi, all of Japan

[73] Assignee: Minolta Camera Kabushiki Kaisha, Osaka, Japan

[21] Appl. No.: 73,307

[22] Filed: Jun. 8, 1993

[30] Foreign Application Priority Data

Jun. 16, 1992 [JP] Japan ..... 4-156530

[51] Int. Cl.[6] ..... B65H 85/00

[52] U.S. Cl. ..... 271/3; 271/3.1; 271/7; 271/273; 271/275; 271/198

[58] Field of Search ..... 271/3/3.1, 7, 275, 273, 271/198

[56] References Cited

U.S. PATENT DOCUMENTS 4,285,512 8/1981 Shlatz ..... 271/233

5,060,923 10/1991 Takimoto et al. ..... 271/7

5,292,113 3/1994 Morigami et al. ..... 271/7

FOREIGN PATENT DOCUMENTS 59-159182 9/1984 Japan .

*Primary Examiner*—David H. Bollinger

*Attorney, Agent, or Firm*—Burns, Doane, Swecker & Mathis

[57] ABSTRACT

An automatic document feeder provided with a conveying unit which has a conveyer belt and regulating plates for regulating a space between the conveying unit and a platen glass. The regulating plates are disposed in a hinge side and a side opposite to the hinge side. The conveying unit is connected with a supporting frame through the regulating plates. The supporting frame is fixed to the hinges. The conveying unit is movable in a vertical direction to the supporting frame at least in the hinge side.

7 Claims, 3 Drawing Sheets

AUTOMATIC DOCUMENT FEEDER

BACKGROUND OF THE INVENTION

1. Field of the invention

The present invention relates to an automatic document feeder, and more particularly to an automatic document feeder which feeds a document onto a platen glass of a copying machine automatically and ejects it therefrom.

2. Description of Related Art

Recently, in a field of electrophotographic copying machines, various automatic document feeders (ADF) are provided to save a trouble of changing documents and develop the copy processing ability. An ADF feeds a document one by one from a tray and sets it in a specified position on a platen glass and ejects it therefrom after the document is scanned.

The ADF is fitted by hinges in a rear side of the copying apparatus and is capable of pivoting on the hinges so as to be lifted up when an operator sets a document on the platen glass manually. A conveyer belt of the ADF has to be in contact with the platen glass evenly.

However, because of errors in production of the parts and in assembly of the machine, a problem occurs in setting the conveyer belt on the platen glass. For example, because the level difference between the surface on which the hinges are fixed and the surface of the platen glass varies from machine to machine or because the surface on which the hinges are fixed and the surface of the platen glass may not be exactly parallel to each other, the conveyer belt can not be in contact with the platen glass entirely with an even pressure.

Conventionally, in order to solve the problem, when the machine is set up, spacers are provided between the surface of the machine body and the hinges so that the level of the hinges can be adjusted to the level of the surface of the platen glass. However, this adjustment must be carried out differently and properly for each machine, and this is troublesome.

In order to save the adjustment, as shown in FIG. 5, a whole ADF 10 including a document conveying section is fitted to a supporting flame 24 through regulating plates 11 and 12 and is capable of pivoting on hinges 20. Thereby, the difference in angle between the platen glass and the ADF 10 can be decreased. However, in the ADF 10, while the ADF 10 is closing, when the regulating plate 11 which is provided in the rear side of the ADF 10 comes into contact with the platen glass 31, the weight of the whole ADF 10 is applied on the contact portion of the platen glass 31 and at the same time, the load on the hinge 20 is decreased rapidly. This means that a power which is needed to close the ADF 10 (pressing power) further from the state of FIG. 5 becomes larger. This causes an inconvenience in the operation, and a magnet 15 which is used for keeping the ADF 10 in contact with the apparatus body 30 requires a larger magnetic power. A dashed line shown in a graph of FIG. 3 shows a change of the pressing power which is needed to close the ADF 10. This shows that the pressing power becomes larger by $\alpha$ rapidly when the opening angle of the ADF 10 goes over a free stop area.

SUMMARY OF THE INVENTION

An object of the present invention is to provide an automatic document feeder of which operation of opening and closing is smooth.

Another object of the present invention is to provide an automatic document feeder wherein adjustment of a height of conveying means is not necessary.

In order to attain the objects, an automatic document feeder (ADF) according to the present invention comprises a main frame; conveying means for conveying a document on the platen glass; hinge means for supporting the main frame such that the main frame is capable of pivoting on the hinge means to the platen glass; supporting means, which is connected to the hinge means, for fitting the conveying means to the main frame such that the conveying means is movable in a vertical direction to the main frame at least in a hinge means side; and regulating means, which is fitted to the supporting means, for regulating a space between the conveying means and the platen glass, the regulating means including a first member which is provided in the hinge means side of the conveying means and a second member which is provided in a side opposite to the hinge means side, the first member being movable in a vertical direction to the supporting means.

While the ADF is closing, when the ADF goes over the free stop area, the first member which is provided in the hinge means side comes into contact with the platen glass. In the present invention, since the conveying means is connected with the supporting means by the first member movable in a vertical direction to the supporting means, when the first member contacts with the platen glass, a decrease in the load on the hinge means corresponds to the weight of the conveying means. Thus, the pressing power which is needed to close the ADF further from the free stop area is not so large (refer to a solid line which shows a change of the pressing power $\beta$ in FIG. 3. $\alpha$ shows the one in the prior art). This makes the operation of opening and closing the ADF smoother and a magnetic power which is needed to keep the ADF closed does not have to be so strong.

Also, in the present invention, since the space and parallelism between the conveying means and the platen glass are regulated precisely, the document conveying ability is developed and the adjustment of the height of the ADF, when the ADF is set up, is not necessary.

BRIEF DESCRIPTION OF THE DRAWINGS

These and other objects and features of the present invention will become apparent from the following description with reference to the accompanying drawings, in which.

DETAILED DESCRIPTION OF THE PREFERRED EMBODIMENTS

Figure 1:
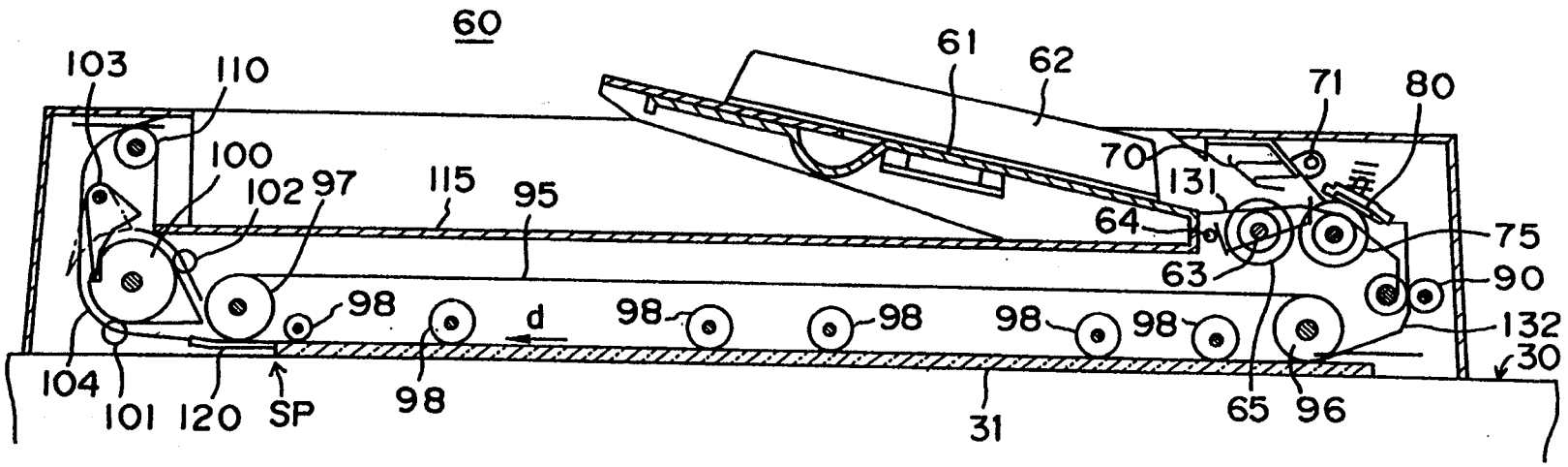
FIG. 1 is a sectional view which shows a schematic structure of an ADF which is a first embodiment of the present invention.

The description of preferred embodiments according to the present invention is given below, referring to the drawings.

FIRST EMBODIMENT

Figure 2:
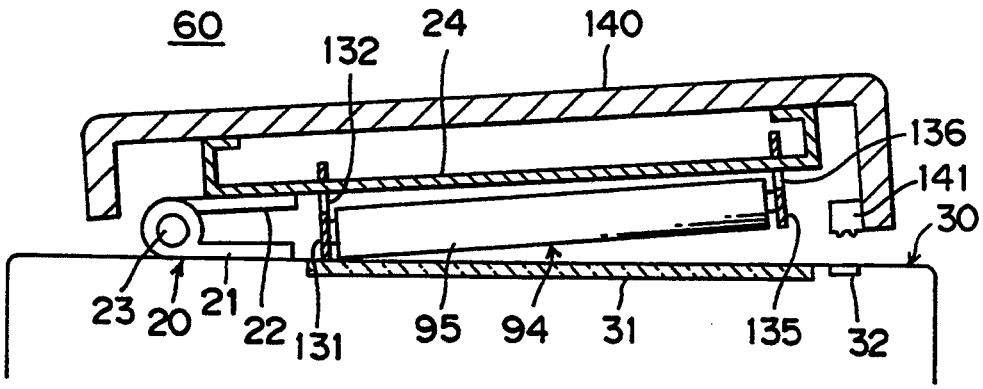
FIG. 2 is a sectional view of the ADF fitted to a copying machine is a state that the ADF is opened a little.
Figure 3:
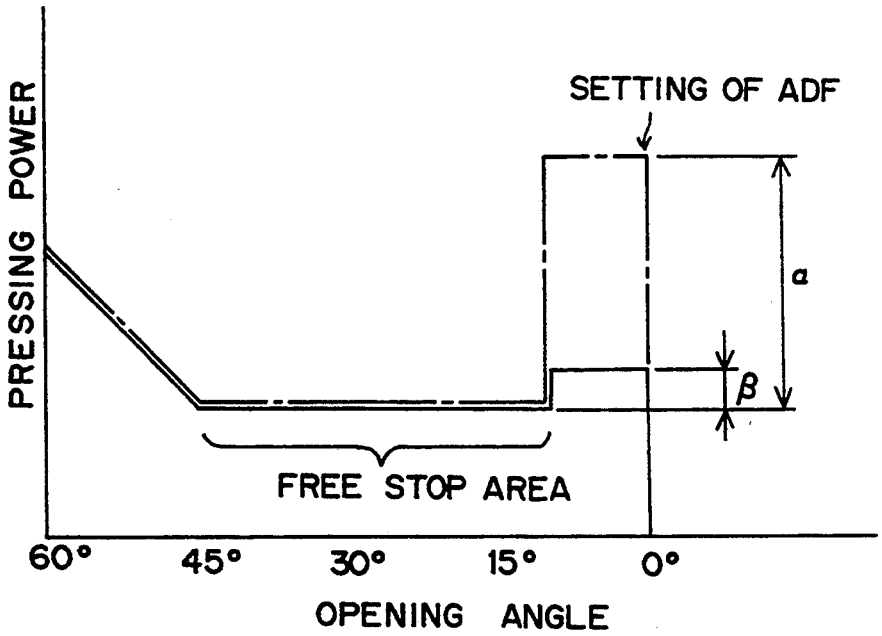
FIG. 3 is a graph which shows a change of a pressing power which is necessary to close the ADF.

FIGS. 1 through 3

The structure and the operation of the ADF 60 are hereinafter described referring to FIG. 1.

The ADF 60 mainly consists of a document tray 61, side regulation plates 62, a leading edge regulation plate 63, a pick-up roller 65, a document pressing plate 70, a separation roller 75, a separation pad 80, a register roller pair 90, a conveyer belt 95, a reversing roller 100, an ejection roller 110 and an ejected-document tray 115. The ADF 60 is mounted on a copying machine body 30 such that the conveyer belt 95 is positioned on a platen glass 31. The ADF 60 is fitted to the body 30 by hinges (not shown) in the rear side and is capable of pivoting on the hinges so as to cover and uncover the platen glass 31 (explained in detail later). If the operator wishes to set an document on the platen glass 31 manually, the ADF 60 shall be lifted up.

Documents are stacked on the tray 61 with the first page on the top and facing up. The sides of the stack of documents are regulated by the side regulation plates 62, and the leading edge of the stack of documents is regulated by the leading edge regulation plate 63.

The leading edge regulation plate 63 and the pressing plate 70 are pivoted on shafts 64 and 71 respectively. The leading edge regulation plate 63, while the documents are being fed one by one from the first to the last, is kept in a retreating position. The pressing plate 70, when each document is to be fed out of the tray 61, pivots downward from a retreating position indicated with a solid line in FIG. 2 so as to press the leading portion of the stack of documents against the pick-up roller 65.

The pick-up roller 65 and the separation roller 75 are driven to rotate clockwise so as to feed a document out of the document tray 61. The feeding starts with the bottom of the stack of documents. Each document fed out of the tray 61 passes between the separation roller 75 and the separation pad 80 and is transported to the register roller pair 90.

The document transported to the register roller pair 90 is once stopped. After a specified time, the register roller pair 90 is driven to rotate, whereby the document is transported to the entrance of the platen glass 31.

The conveyer belt 95 is stretched between a driving roller 96 and a driven roller 97 endlessly such that the belt 95 covers the platen glass 31 entirely. A number of back-up rollers 98 are provided inside the round of the conveyer belt 95 so as to press the belt 95 against the platen glass 31. The conveyer belt 95 is driven to rotate in a direction indicated with an arrow d, and the document is set such that the leading edge is positioned at a scanning reference point SP which is the border of a scale 120 and the platen glass 31.

The reversing roller 100 is provided with pinch rollers 101 and 102. Further, for reversing a duplex document (document which has images on both sides), a diverter 103 is provided. The diverter 103 is usually in a position indicated with a solid line. After scanning, the document is discharged from the platen glass 31 with rotation of the conveyer belt 95 in the direction which is indicated with an arrow d and clockwise rotation of the reversing roller 100. Then, the document is guided upward by a guide plate 104 and the diverter 103 in the position of the solid line and ejected onto the ejected-document tray 115 through the ejection roller 110. In a case of feeding of a duplex document, the diverter 103 is switched to be in a position indicated with a dashed line. In copying of a duplex document, its reverse side (latter page) of the document is first copied. Therefore when the document is fed from the tray 61 onto the platen glass 31, the diverter 103 is set in the position indicated with the dashed line, and in order to place the document with its reverse side facing down, the document passes through the platen glass 31 and is turned over by the reversing roller 100. Then, with reverse rotation (rotation in a direction reverse to arrow d) of the conveyer belt 95, the document is set on the platen glass 31. After scanning of the reverse side, the document is turned over by the reversing roller 100 again and returned onto the platen glass 31, whereby the document is set on the platen glass 31 with its front side facing down.

Next, a fitting structure of the ADF 60 to the copying machine body 30 is described below referring to FIG. 2.

Two hinges 20 are provided in the rear side of the body 30. The hinges 20 are of a well known type. Each of the hinges 20 consists of a fixing member 21, a movable member 22 which pivots on a pin 23 and a spring member (not shown) which urges the movable member 22 upward on the pin 23.

In the ADF 60, a conveying unit 94 is mainly composed of the conveyer belt 95, supporting rollers 96 and 97 and back-up rollers 98. The conveying unit 94 further has a regulating plate 131 which is provided in a rear side and a regulating plate 135 which is provided in the front side. The conveying unit 94 is fitted to a supporting frame 24 through the regulating plates 131 and 135. The supporting frame 24 is fitted to the movable members 22 of the hinges 20. The regulating plates 131 and 135 are movable in a vertical direction to the supporting frame 24 by longitudinal slots 132 and 136. Thus, the conveying unit 94 is fitted to the supporting frame 24 such that the conveying unit 94 is hanging from the supporting frame 24.

Also, other parts of the ADF 60 are fitted to the main frame 140 which is fixed to the supporting frame 24. A plurality of magnets 141 are fixed to a front side of the main frame 140, and magnetic plates 32 are provided on the body 30 in a position facing the magnets 141. When the ADF 60 is closed, the magnets 141 and the magnetic plates 32 attract each other and ensure that the ADF 60 is closed. Further, one of the magnets 141 includes a lead switch (not shown). The lead switch is turned on when the magnets 141 come in contact with the magnetic plates 32 and detects that the ADF 60 is set on the platen glass 31 correctly. The ADF 60 becomes operable by receiving this detecting signal.

In the above structure, when the ADF 60 is closed, the regulating plates 131 and 135 are in contact with the platen glass 31. Thereby, the space and parallelism between the conveying unit 94 and the platen glass 31 are regulated. Since the conveying unit 94 is connected with the supporting frame 24 through the regulating plates 131 and 135 which are connected with the supporting frame 24 through the slots 132 and 136 which have clearances, an error of the fitting height of the hinges 20 is corrected automatically, and the ADF 60 is kept in a specified position from the platen glass 31. Therefore, a fine document conveying ability can be obtained without adjusting the height of the hinges 20.

Figure 5:
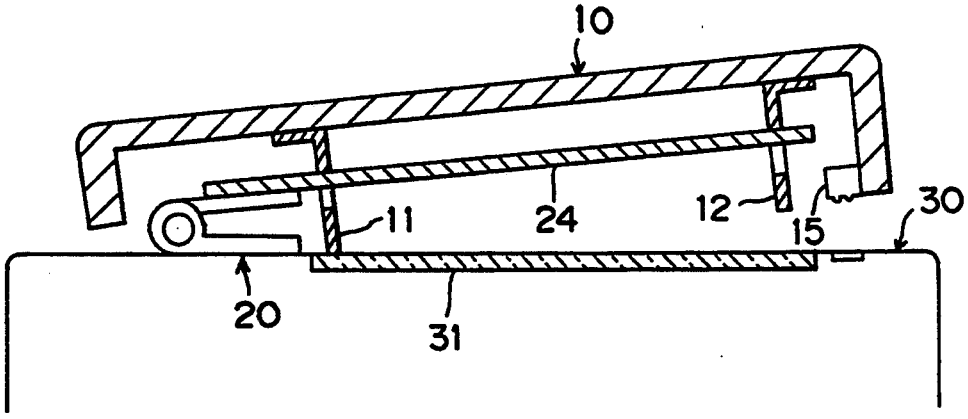
FIG. 5 PRIOR ART
FIG. 5 is a sectional view which shows an fitting structure of an ADF of prior art.

On the other hand, when the ADF 60 is opened upward pivoting on the pins 23 of the hinges 20, the whole weight of the ADF 60 is applied on the hinges 20 through the supporting frame 24. In the area where the weight balances with a spring power of the hinge springs (not shown), the ADF 60 is kept still (in the free stop area shown in the graph of FIG. 3). In FIG. 3, the solid line shows a change of the pressing power which is necessary to close the ADF 60 according to the present invention. After the ADF 60 is opened wider than the free stop area, wider the ADF 60 opens, larger the pressing power becomes. This characteristic is the same in the prior art shown in FIG. 5 (In FIG. 3, the dashed line shows a change of the pressing power which is necessary to close the ADF in the prior art in FIG. 3).

However, in the present invention, while the ADF 60 is closing, when the ADF 60 goes over the free stop area, first, the regulating plate 131 which is provided in the rear side comes into contact with the platen glass 31. At that time, the weight of the conveying unit 94 is applied to the platen glass 31 through the regulating plate 131. This weight is much smaller than the whole weight of the ADF which is applied to the platen glass 31 through the regulating plate 11 in the ADF of prior art. Thus, in the present invention, since the weight applied to the platen glass 31 is smaller than that of the prior art, the resiliency of the hinge spring does not change largely. Accordingly, the pressing power which is necessary to close the ADF 60 is $\beta$ which is much smaller than $\alpha$ required in the prior art. This makes the operation of opening and closing the ADF 60 much smoother. Also, this helps to keep the ADF 60 in a closed position without increasing the magnetic power of the magnets 141.

SECOND EMBODIMENT

FIG. 4

Figure 4:
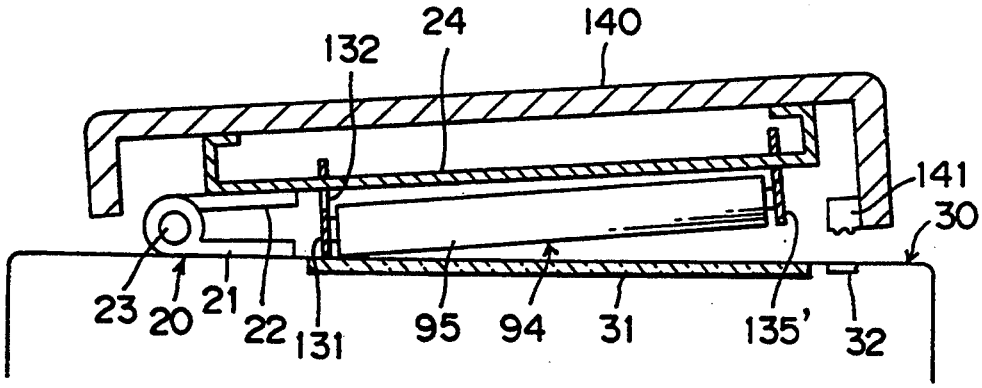
FIG. 4 is a sectional view of an ADF which is a second embodiment of the present invention, the ADF being fitted to a copying machine and opened a little.

FIG. 4 shows an ADF which is a second embodiment of the present invention. The general structure of the ADF and the structure of the conveying unit 94 are the same as the one of the first embodiment. Therefore, in FIG. 4, the same reference numerals are used to indicate the same members of the first embodiment shown in FIG. 2.

A difference between the first embodiment and the second embodiment is that, in the second embodiment, a regulating plate 135' is fixed to the supporting frame 24 without having a clearance. The pressing power which is necessary to close the ADF toward the platen glass 31 is changed in the same characteristic which is shown in FIG. 3.

Although the present invention has been described in connection with the preferred embodiments above, it is to be noted that various changes and modifications are apparent to a person skilled in the art. Such changes and modifications are to be understood as being within the scope of the present invention.

What is claimed is:

1. An automatic document feeder comprising:

a main frame;

conveying means for conveying a document on a platen glass;

hinge means for supporting the main frame such that the main frame is capable of pivoting on the hinge means toward the platen glass;

supporting means for movably mounting the conveying means the main frame such that the conveying means is movable in a vertical direction to the main frame at least on a hinge means side; and regulating means for regulating a space between the conveying means and the platen glass;

wherein the regulating means includes a first member attached to said supporting means on the hinge means side of the conveying means and a second member fixed to said supporting means on the opposite side of said conveying means;

wherein the first and the second members are fixed to the conveying means on the hinge side and on the opposite side respectively.

2. An automatic document feeder as claimed in claim 1, wherein the supporting means is connected with the hinge means.

3. An automatic document feeder as claimed in claim 1, wherein the first member is movably attached to said supporting means so as to be movable in a vertical direction to the supporting means.

4. An automatic document feeder for conveying and stopping a document in a specified position on a platen glass and ejecting the document therefrom after scanning of the document comprising:

a main frame;

conveying means for conveying a document on the platen glass;

hinge means for supporting the main frame such that the main frame is capable of pivoting on the hinge means to the platen glass;

supporting means for fitting the conveying mans to the main frame such that the conveying means is movable in a vertical direction to the main frame at least in a hinge means side; and regulating means for regulating a space between the conveying means and the platen glass, the regulating means including a first member which is attached to said supporting means on the hinge means side of the conveying means and a second member which is fixed to said supporting means on a side opposite to the hinge means side;

wherein the first and the second members are fixed to the conveying means on the hinge means side and on the opposite side respectively.

5. An automatic document feeder as claimed in claim 4, wherein the supporting means is connected with the hinge means.

6. An automatic document feeder as claimed in claim 4, wherein the first member is movably attached to said supporting means so as to be movable in a vertical direction to the supporting means.

7. An automatic document feeder for conveying and stopping a document in a specified position on a platen glass and ejecting the document therefrom after scanning of the document:

a main frame;

conveying means for conveying a document on the platen glass;

hinge means for supporting the main frame such that the main frame is capable of pivoting on the hinge means to the platen glass;

supporting means, which is connected to the hinge means, for fitting the conveying means to the main frame such that the conveying means is movable in a vertical direction to the main frame at least in a hinge means side; and regulating means, which is fitted to the supporting means, for regulating a space between the conveying means and the platen glass, the regulating means including a first member attached to said supporting means on the hinge means side of the conveying means and a second member fixed to the supporting means on a side opposite to the hinge means side, the first member being movably attached to said supporting means so as to be movable in a vertical direction to the supporting means.

* * * * *